United States Patent [19]

Wada

[11] Patent Number: 4,591,332

[45] Date of Patent: May 27, 1986

[54] CONTROL DEVICE OF A COMBUSTION APPARATUS

[75] Inventor: Chuzoh Wada, Nara, Japan

[73] Assignee: Matsushita Electric Industrial Co., Ltd., Kadoma, Japan

[21] Appl. No.: 654,173

[22] Filed: Sep. 25, 1984

[30] Foreign Application Priority Data

Sep. 27, 1983 [JP] Japan ..... 58-178539
Sep. 27, 1983 [JP] Japan ..... 58-178540
Oct. 24, 1983 [JP] Japan ..... 58-164424

[51] Int. Cl.[4] ..... F23N 5/00

[52] U.S. Cl. ..... 431/62; 431/66; 431/77

[58] Field of Search ..... 431/66, 75, 62, 77, 431/78

[56] References Cited

U.S. PATENT DOCUMENTS 3,540,817 11/1970 Tyler ..... 431/66
3,577,209 5/1971 Perkins ..... 431/66

*Primary Examiner*—Henry Bennett
*Attorney, Agent, or Firm*—Cushman, Darby & Cushman

[57] ABSTRACT

The feature of the present invention is that in the control device of the combustion apparatus, comprising an operational amplifier which compares a capacitor voltage charged by a flame rod current, with a reference voltage, thereby to issue an unusual signal, the reference voltage or the capacitor voltage is changed according to the atmosphere temperature by utilizing a thermo sensitive element, thereby the comparing operation is executed correctly irrespective of the atmosphere temperature.

9 Claims, 10 Drawing Figures

CONTROL DEVICE OF A COMBUSTION APPARATUS

BACKGROUND OF THE INVENTION

1. Field of the Invention

The present invention relates to a control device of a combustion apparatus for detecting an unusual state, for example, oxyzen deficient state of the combustion apparatus which warms a room by sending out a combustion gas in the room and so on.

2. Description of the Prior Art

A combustion apparatus, for example, an oil combustion apparatus, for example, for warming a room by sending out a combustion gas in the room, generally comprises an oil tank 3 and a burner 4 displaced in a space surrounded by a housing 1 and a base 2 as shown in FIG. 7. A netlike gushing part 6 is arranged at a top of the main body 5 of the burner 4 as shown in FIG. 8. Evaporated oil mixed beforehand with an air gushes from the net of the gushing part 6 and is ignited by a spark emitted from a ignition electrode 7 to the net of the gushing part 6, and the evaporated oil burns. As shown in FIG. 7, the combustion gas A of the burner 4 is mixed with an air B draughted from the room to be heated by a fan 9 driven with a motor 8. The mixed warm gas C is sent out through a louver 10 and warms the room.

It is feared that an oxygen deficiency accident occurs when such combustion apparatus which consumes oxygen in the room for the combustion is used for a long time with the room being shut tightly. Then such combustion apparatus has a flame rod 12 disposed in a flame 11 of the burner 4, for detecting oxygen deficient state. That is, when the oxygen deficiency occurred the flame 11 becomes extremely unstable and a flame rod current which flows between the flame rod 12 and the burner 4 through the flame 11 decreases. Therefore, when the flame rod current decreases less than a predetermined value, it is judged that the oxygen deficient state occurs, and the combustion in the combustion apparatus is automatically stopped. A conventional control device for executing the above-mentioned operation is disclosed in FIG. 9.

An alternating current power source 13, point a, a first relay contact 14, a burner heater 15, point b and a driving switch 16 together form a closed loop circuit. A second relay contact 17 and a parallel circuit of a fan motor 5 and a burner motor 18 are connected between the point a and the point b as shown in FIG. 9. Further, a third relay contact 19, point c and an oil pump 20 are connected between the point a and the point b. A high tension ignition device 21 is connected between point c and point b as shown in FIG. 9. A control circuit 22 including a relay control circuit and a safety device control circuit is connected between point a and point b.

Further, a DC constant voltage power source 23, point d, a resistance 24, point e, a resistance 25 and point f together form a closed loop circuit. An AC power source 26, a protection resistance 27, point g, a parallel circuit of a resistance 28, a capacitor 29, point f, the flame rod 12 and the burner 4 together form a closed loop circuit. The voltage at point g is supplied to a plus input terminal of an operational amplifier 30 for detecting an oxygen deficiency. The voltage at point e is supplied as a reference voltage to a minus input terminal of the operational amplifier 30. An output signal of the operational amplifier 30 is supplied to the control circuit 22.

The operation of the conventional control device in FIG. 9 is as follows. When the driving switch 16 is closed, the first, second and third relays 14, 17 and 19 are closed by the control circuit 22 and the heater 15 heats a carburetor in the burner 4, thereby to maintain the carburetor at a constant temperature. Accordingly, an oil sent into the carburetor by the oil pump 20 is evaporated and is mixed with an air sent in by the burner motor 18. The mixed evaporated oil gushes out from the netlike gushing part 6. The ignition device 21 makes a spark between the ignition electrode 10 and the netlike gushing part 6, thereby to ignite the evaporated oil. A flame rod current flows through the flame of the ignited oil between the flame rod 12 and the burner 4. As a result, a voltage is impressed to the parallel circuit of the resistance 28 and the capacitor 29. Incidentally, the circuit of the flame rod 12, the flame and the burner 4 has a function of rectification. The voltage at point g is supplied to the plus input terminal of the operational amplifier 30.

On the other hand, a constant voltage at point e, determined by dividing the voltage of the DC constant voltage power source 23 with the resistances 24 and 25, is supplied to the minus input terminal of the operational amplifier 30.

Then, the flame rod current changes according to the various combustion state, therefore the voltage at point g also changes. The variation is described by using FIG. 10. The voltage $E_0$ at point e is normally constant as apparent from the above-mentioned matter. On the contrary, the voltage at point g varies. That is, the voltage at point g is 0 when the combustion apparatus does not burn. When the combustion apparatus burns, after a predetermined time from the ignition, the voltage at point g increases and becomes a voltage $G_1$ which is larger than the voltage $E_0$ at point e. Therefore, the operational amplifier 30 does not issue an oxygen deficient signal to the control circuit 22.

Incidentally, the operational amplifier 30 operates only after the predetermined time from the ignition, by utilizing a timer. Therefore, an erroneous operation of the operational amplifier 30 at a starting time of the combustion apparatus can be prevented.

When an oxygen deficiency occurs the flame rod current decreases and the voltage at point g decreases largely to a voltage $G_3$ and becomes less than the voltage $E_0$ at point e. Accordingly, the operational amplifier 30 issues an oxygen deficiency signal to the control circuit 22.

Then, as above-mentioned, the conventional control device of the combustion apparatus can operate normally so far as an atmosphere temperature is normal.

In case, when the atmosphere temperature is low, for example, at 0° C. to −20° C., the density of the air increases, but the oil supply amount does not increases for the raise of the density of the air. As a result, the air becomes oversupplied and the flame transfers upwards, thereby the flame rod current decreases. Therefore, the voltage at point g becomes voltage $G_2$ which is lower than voltage $E_0$ as shown by a chain line g' in FIG. 10. Then, the operational amplifier 30 issues an unusual signal and the combustion of the combustion apparatus is stopped, even though the oxygen deficiency does not occurs. As mentioned above, the conventional control device of the combustion apparatus has a disadvantage.

SUMMARY OF THE INVENTION

A purpose of the present invention is to provide a control device of a combustion apparatus, which can detect unusual state of the combustion of the combustion apparatus even when an atmosphere temperature is low.

A control device of a combustion apparatus of the present invention comprises:

an alternating power source for impressing a voltage between a burner and a flame rod through a parallel circuit of a capacitor and a resistance, a reference voltage producing circuit for producing a reference voltage an operational amplifier for receiving the reference voltage and the voltage of the capacitor, and comparing the two voltages, thereby to detect an unusual state of the combustion and to issue an unusual signal to a control circuit of the combustion apparatus, a thermo sensitive element connected to the parallel circuit or the reference voltage producing circuit, for varying the voltage of the capacitor or the reference voltage according to an atmosphere temperature.

The control device of a combustion apparatus of the present invention can comprise further a second operational amplifier for receiving a second reference voltage and the voltage of the capacitor, and comparing the two voltages, thereby to detect an ignition completing state and to issue an ignition completing signal to the control circuit of the combustion apparatus.

DESCRIPTION OF A PREFERRED EMBODIMENTS

Figure 1:
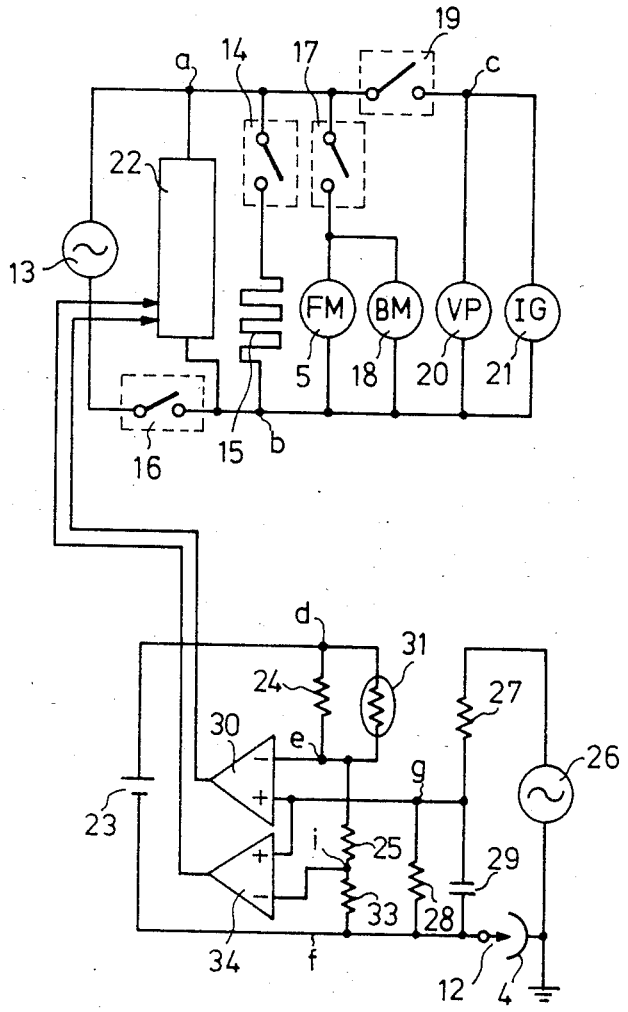
FIG. 1 is a circuit diagram showing an embodiment of a control device of a combustion apparatus of the present invention.

A structure of a preferred embodiment of a control device of the combustion apparatus of the present invention is shown in FIG. 1.

That is, an alternating current power source 13, point a, a first relay contact 14, a burner heater 15, point b and a driving switch 16 together form a closed loop circuit. A second relay contact 17 and a parallel circuit of a fan motor 5 and a burner motor 18 are connected between the point a and the point b as shown in FIG. 1. Further a third relay contact 19, point c and an oil pump 20 are connected between the point a and the point b as shown in FIG. 1. A high tention ignition device 21 is connected between point c and poing b. A control circuit 22 including a relay control circuit and a safety device control circuit is connected between point a and point b.

Further a DC constant voltage power source 23, point d, a resistance 24, point e, a resistance 25, a resistance 33 and point f together form a closed loop circuit. An AC power source 26, a protection resistance 27, point g, a parallel circuit of a resistance 28 and a capacitor 29, point f, the flame rod 12 and the burner 4 together form a closed loop circuit. The voltage at point g is supplied to a plus input terminal of an operational amplifier 30 for detecting an oxygen deficiency and the voltage at point e is supplied to a minus input terminal of the operational amplifier 30. An output signal of the operational amplifier 30 is supplied to the control circuit 22.

Figure 2:
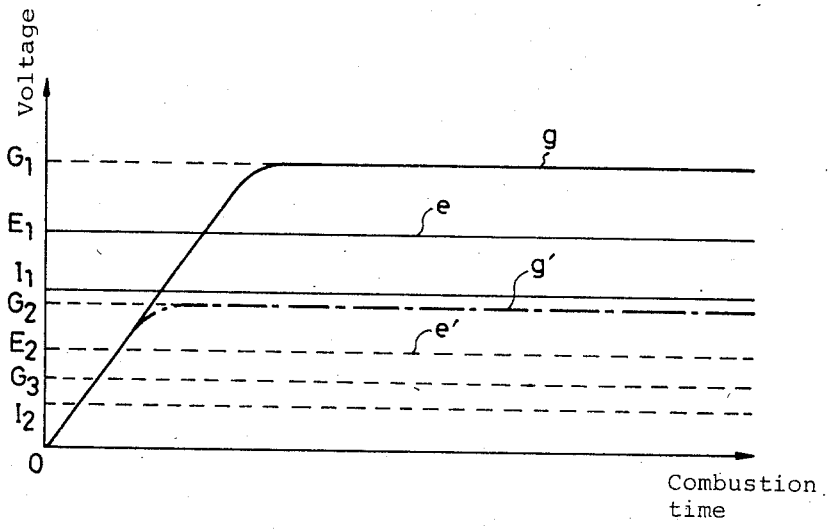
FIG. 2 is a graph showing a correlation of a capacitor voltage, a reference voltage, a combustion time and atmosphere temperature in the embodiment of FIG. 1.

Further, the embodiment of the FIG. 1 has a thermistor 31 as a thermo sensitive element which is connected to the resistance 24 in parallel. A resistance value of the thermistor 31 is small when the atmosphere temperature is at normal temperature. Therefore, the voltage at point e is high ($E_1$) as shown in FIG. 2. When the atmosphere temperature is at low temperature, for example, $-10°$ C., the resistance value of the thermistor 31 is large and the voltage at point e is low ($E_2$) indicated by broken line e'.

On the other hand, the voltage at point g is high ($G_1$) enough when the atmosphere temperature is at normal temperature as shown in FIG. 2. Therefore, the control device of the present invention operates normally.

When the atmosphere temperature is at low temperature, for example, at $-10°$ C., the voltage at point g is low ($G_2$) as mentioned previously. Then the voltage at point e is low ($E_2$) enough which is less than the voltage $G_2$ as mentioned above when the atmosphere temperature is low, therefore the operational amplifier 30 does not issue an unusual signal when the combustion state does not occur. Accordingly even when the combustion apparatus is used at low temperature, such erroneous accident does not occur that the unusual signal, for example, oxygen deficiency signal is issued from the operational amplifier 30 though the oxygen deficiency does not occur.

Thus, when the oxygen deficiency occurs, the voltage at point g decreases to the voltage $G_3$ which is less than the reference voltage at point e, which is high ($E_1$) at normal temperature and is low ($E_2$) at low temperature and the operational amplifier 30 issues the unusual signal to the control circuit 22. Then the combustion of the combustion apparatus is stopped safely.

Figure 3:
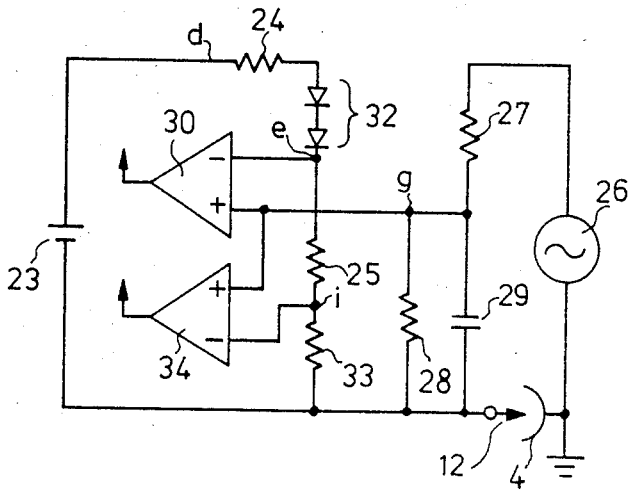
FIG. 3 is a part of a circuit diagram showing a still embodiment of the control device of the combustion apparatus of the present invention.

Another embodiment of the control device of the combustion apparatus of the present invention is shown in FIG. 3. Several diodes 32 are connected in series to the resistance 24 instead of the parallel circuit of the thermistor 31 and the resistance 24. When the atmosphere temperature is low, the voltage drop of the diode 32 is large and the voltage at point e is low enough, thereby the diode 32 shows same function of the thermistor 31.

Figure 4:
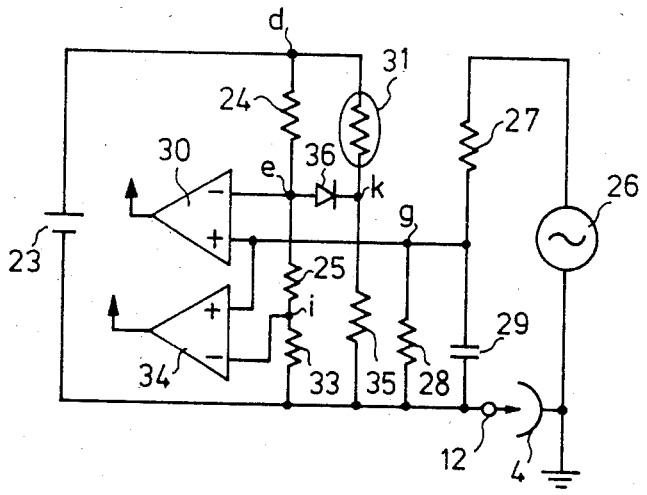
FIG. 4 is a part of a circuit diagram showing a still embodiment of the control device of the combustion apparatus of the present invention.

Another embodiment of the control device of the combustion apparatus of the present invention is shown in FIG. 4. A series circuit of a thermistor 31 and a resistance 35 is connected in parallel with a series circuit of the resistances 24, 25 and 33. Further a diode 36 is connected between point e and a connection point k of the thermistor 31 and the resistance 35. In this embodiment, when the atmosphere temperature is low, the resistance value of the thermistor 31 is large and the voltage at point k is low, therefore the voltage at point e becomes low through the diode 36, thereby the erroneous operation can be prevented.

Figure 5:
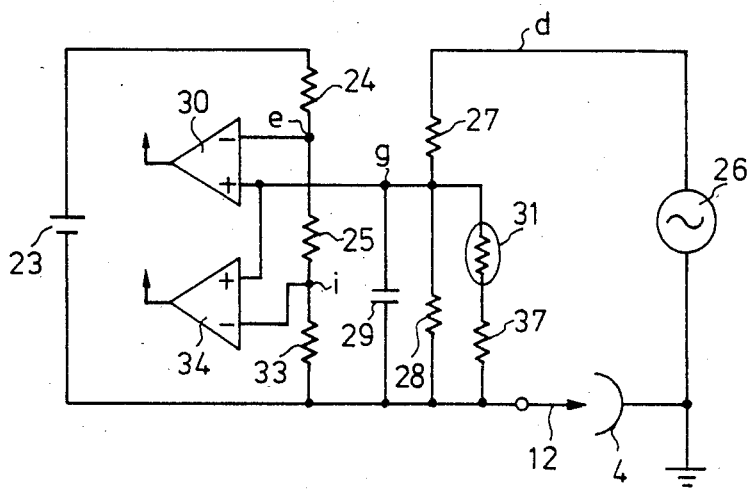
FIG. 5 is a part of a circuit diagram showing a still embodiment of the control device of the combustion apparatus of the present invention.

Another embodiment of the control device of the combustion apparatus of the present invention is shown in FIG. 5. In this embodiment, a series circuit of a resistance 37 and a thermistor 31 is connected to the resistance 28 in parallel. When the atmosphere temperature is low the resistance value of the thermistor 31 is large, therefore the total resistance value of the resistances 28, 31 and 37 is also large. Accordingly, even though the flame rod current decreases, namely, the resistance value between the flame rod 12 and the burner 4 increases on account of the low atmosphere temperature, the total resistance value at low atmosphere temperature is larger than that at normal atmosphere temperature, therefore the voltage of the capacitor 29 can be maintained constant Accordingly, both the voltage at point g and the voltage at point e have no connection with the atmosphere temperature. Thus the erroneous operation caused by the temperature fluctuation can be prevented.

Figure 6:
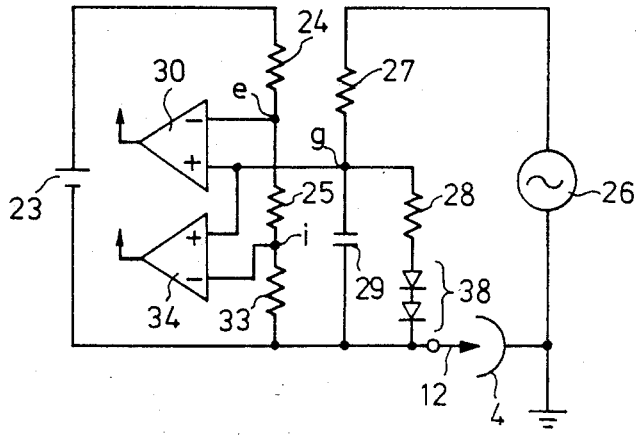
FIG. 6 is a part of a circuit diagram showing a still embodiment of the control device of the combustion apparatus of the present invention.
Figure 7:
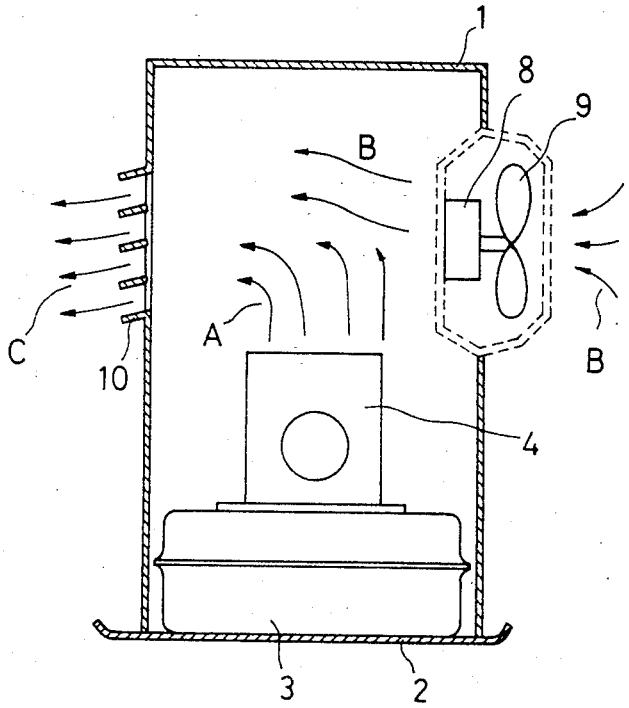
FIG. 7 is an abridged cross-sectional view of a conventional oil combustion apparatus.
Figure 8:
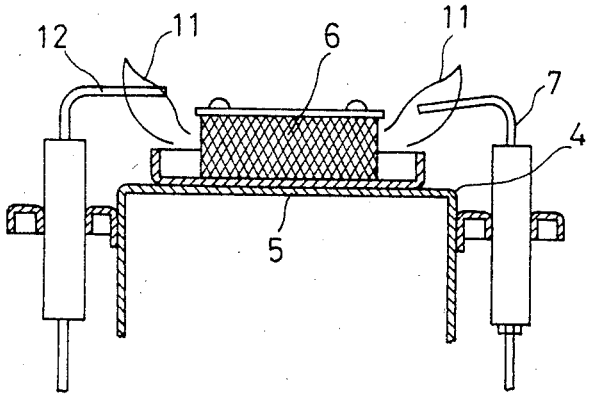
FIG. 8 is a partly cut cross-sectional view of a burner of the conventional oil combustion apparatus of FIG. 7.
Figure 9:
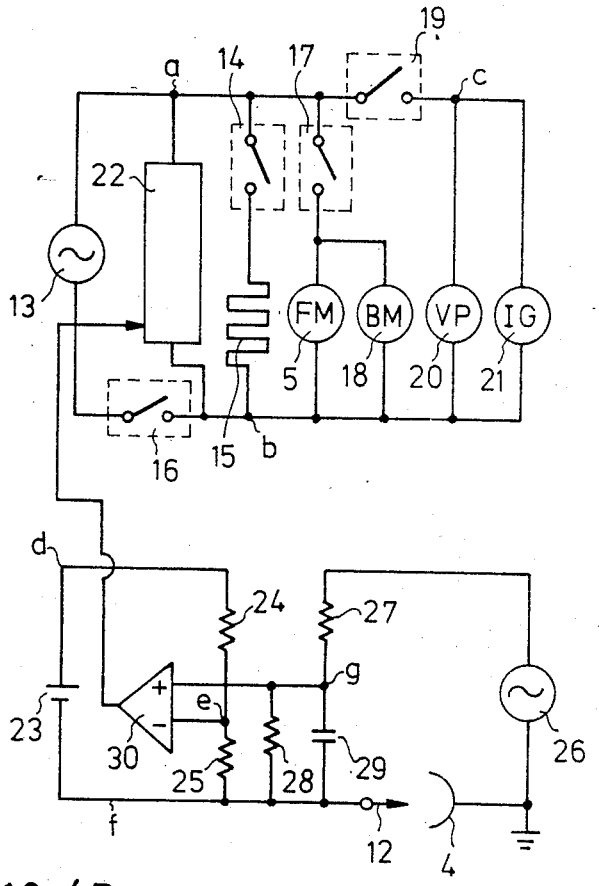
FIG.9 (Prior Art)
FIG. 9 is a circuit diagram of a control device of the conventional oil combustion apparatus of FIGS. 7 and 8.
Figure 10:
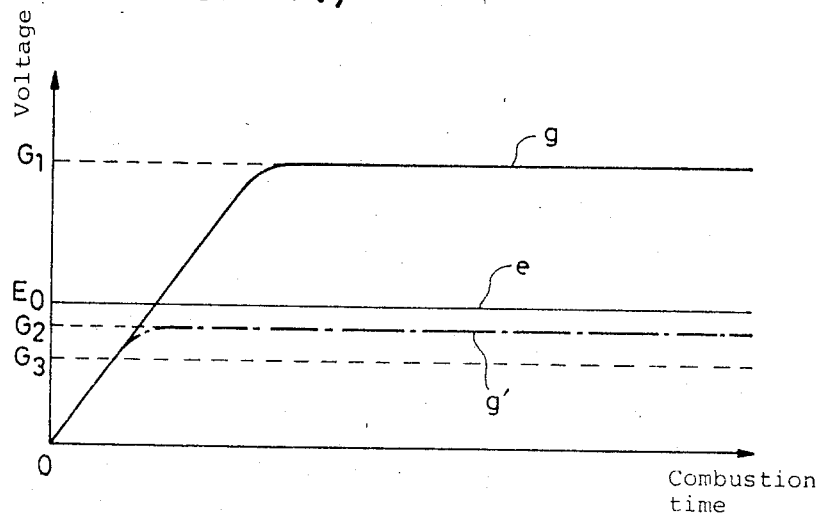
FIG.10 (Prior Art)
FIG. 10 is a graph showing a correlation of a capacitor voltage, a reference voltage and a combustion time in the embodiment of FIG. 9.

Another embodiment of the control device of the combustion apparatus of the present invention is shown in FIG. 6. Several diodes 38 are connected with the resistance 28 in series, thereby the voltage at point g can be maintained constant as in FIG. 5. The voltage drop of the diode 38 is large at low atmosphere temperature as mentioned in the embodiment of FIG. 3.

Incidentally, in FIGS. 1, 3, 4, 5 and 6, the voltage at point g is issued to a plus input terminal of an operational amplifier 34. The voltage at point i, namely, at connection point of the resistance 25 and the resistance 33, is issued to a minus input terminal of the operational amplifier 34. The voltage at point i is a reference voltage for detecting a completing of the ignition. When the atmosphere temperature is normal, the voltage at point g increases after the ignition as shown by curve line g in FIG. 2. When the voltage at point g goes beyond the reference voltage $I_1$, the operational amplifier 34 issues a signal showing the completing of the ignition to the control circuit 22. The control circuit 22 stops the spark of the ignition electrode 7. Then when the atmosphere temperature is low, in the embodiments of FIGS. 1, 3 and 4 though the voltage at point g does not increase enough as shown by curve line g′ in FIG. 2, the reference voltage at point i is low ($I_2$) enough since the reference voltage at point i decreases by the function of the thermistor 31, the diode 32 or the diode 36. Therefore, the operational amplifier 34 issues the ignition completing signal when the voltage at point g goes beyond the low reference voltage $I_2$. In the embodiments of FIGS. 5 and 6, though the atmosphere temperature is low, the voltage at point g increases enough by the function of the thermistor 31 or the diode 38. Therefore, the operational amplifier 34 operates normally in spite of the low atmosphere temperature.

Though a drawing is not shown, an operational amplifier for detecting a vanishing of the flame can be comprised in the embodiment of the control device of the combustion apparatus. The principle of the operation of the operational amplifier for vanishing is same as the operational amplifier 30 for detecting the oxygen deficiency. The reference voltage can be made lower than the reference voltage for detecting the oxygen deficiency.

As apparent from the above-mentioned description, the control device of the combustion apparatus can make the combustion apparatus operate normally against an unusual combustion state, for example, an oxygen deficiency even when the atmosphere temperature is low.

What is claimed is:

1. A control device of a combustion apparatus comprising:

an alternating power source for impressing a voltage between a burner and a flame rod through a parallel circuit of a capacitor and a resistance, a reference voltage producing circuit for producing a reference voltage, an operational amplifier for inputting said reference voltage and the voltage of said capacitor, and comparing said two voltages, thereby to detect an unusual state of the combustion and to issue an unusual signal to a control circuit of the combustion apparatus, a thermo sensitive element connected to one of said parallel circuit and said reference voltage producing circuit, for varying the respective voltage of one of said capacitor and said reference voltage according to an atmosphere temperature of air supplied to said burner.

2. A control device of a combustion apparatus in accordance with claim 1, wherein said thermo sensitive element is a thermistor.

3. A control device of a combustion apparatus in accordance with claim 1, wherein said thermo sensitive element is a diode.

4. A control device of a combustion apparatus in accordance with claim 1, wherein said reference voltage producing circuit comprises:

a direct power source, a reference resistance circuit connected to said direct power source for dividing the voltage of said direct power source, thereby to produce the reference voltage.

5. A control device of a combustion apparatus in accordance with claim 4, wherein said thermo sensitive element comprises:

a series circuit of a thermistor and a resistance, said series circuit being connected to said reference resistance circuit of said reference voltage producing circuit in parallel, a diode, the anode of which is connected to a reference voltage point of said reference resistance circuit and the cathode of which is connected to the connection point of said thermistor and said resistor of said series circuit.

6. A control device of a combustion apparatus comprising:

an alternating power source for impressing a voltage between a burner and a flame rod through a parallel circuit of a capacitor and a resistance, a reference voltage producing circuit having a direct power source, a reference resistance circuit connected to said direct power source for dividing the voltage of said direct power source, thereby to produce a first reference voltage and a second reference voltage, a first operational amplifier for receiving said first reference voltage and the voltage of said capacitor, and comparing said two voltages, thereby to detect an unusual state of the combustion and to issue an unusual signal to a control circuit of the combustion apparatus, a second operational amplifier for receiving said second reference voltage and the voltage of said capacitor, and comparing said two voltages, thereby to detect an ignition completing state and to issue an ignition completing signal to said control circuit of said combustion apparatus, a thermo sensitive element connected to one of said parallel circuit and said reference voltage producing circuit, for varying the respective voltage of one of said capacitor and said first and second reference voltages according to an atmosphere temperature of air supplied to said burner.

7. A control device of a combustion apparatus in accordance with claim 6, wherein said thermo sensitive element is a thermistor.

8. A control device of a combustion apparatus in accordance with claim 6, wherein said thermo sensitive element is a diode.

9. A control device of a combustion apparatus in accordance with claim 6, wherein said thermo sensitive element comprises:

a series circuit of a thermistor and a resistance, said series circuit being connected to said reference resistance circuit of said reference voltage producing circuit in parallel, a diode, the anode of which is connected to a first reference voltage point of said reference resistance circuit and the cathode of which is connected to the connection point of said thermistor and said resistor of said series circuit.

* * * * *